US007271138B2

(12) United States Patent
Song et al.

(10) Patent No.: US 7,271,138 B2
(45) Date of Patent: Sep. 18, 2007

(54) COMPOSITIONS FOR PROTECTING GLASSWARE FROM SURFACE CORROSION IN AUTOMATIC DISHWASHING APPLIANCES

(75) Inventors: Brian Xiaoqing Song, West Chester, OH (US); Patricia Sara Berger, Cincinnati, OH (US); James Robert Schwartz, West Chester, OH (US); Robert William Corkery, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/963,165

(22) Filed: Oct. 12, 2004

(65) Prior Publication Data

US 2005/0137106 A1 Jun. 23, 2005

Related U.S. Application Data

(60) Provisional application No. 60/511,731, filed on Oct. 16, 2003.

(51) Int. Cl.
*C11D 3/08* (2006.01)
*C11D 7/10* (2006.01)

(52) U.S. Cl. ..... 510/220; 510/227; 510/232; 510/255; 510/401; 510/444; 510/511; 510/514; 510/531; 134/25.2

(58) Field of Classification Search ..... 510/220, 510/227, 232, 255, 401, 444, 511, 514, 531
See application file for complete search history.

(56) References Cited

U.S. PATENT DOCUMENTS

| | | | | |
|---|---|---|---|---|
| 3,669,901 | A * | 6/1972 | Murray | 252/387 |
| 4,612,049 | A * | 9/1986 | Berner et al. | 106/14.13 |
| 4,908,148 | A * | 3/1990 | Caravajal et al. | 510/514 |
| 4,917,812 | A * | 4/1990 | Cilley | 510/227 |
| 4,933,101 | A * | 6/1990 | Cilley et al. | 510/222 |
| 5,803,990 | A * | 9/1998 | Mosser et al. | 148/261 |
| 6,074,464 | A * | 6/2000 | Eddinger et al. | 106/14.12 |
| 6,407,055 | B1 | 6/2002 | Bauer et al. | |
| 6,622,736 | B1 * | 9/2003 | Hahn | 134/25.2 |
| 7,041,628 | B2 * | 5/2006 | Sunder et al. | 510/223 |
| 2004/0121926 | A1 * | 6/2004 | Waits et al. | 510/221 |
| 2004/0162226 | A1 * | 8/2004 | Sunder et al. | 510/220 |
| 2005/0020464 | A1 * | 1/2005 | Smith et al. | 510/220 |

FOREIGN PATENT DOCUMENTS

| | | | |
|---|---|---|---|
| DE | 101 53 5555 A1 | | 5/2003 |
| EP | 383482 | * | 8/1990 |
| EP | 387997 | * | 9/1990 |
| EP | 0 561 452 A1 | | 9/1993 |
| WO | WO 03/104370 A1 | | 12/2003 |

* cited by examiner

*Primary Examiner*—Charles Boyer
(74) *Attorney, Agent, or Firm*—Kevin L. Waugh; Laura R. Grunzinger

(57) ABSTRACT

Through-the-wash automatic dishwashing detergent compositions, especially detergent compositions comprising zinc-containing materials, are provided for protecting glassware from surface corrosion during automatic dishwashing.

4 Claims, 1 Drawing Sheet

Figure 1:
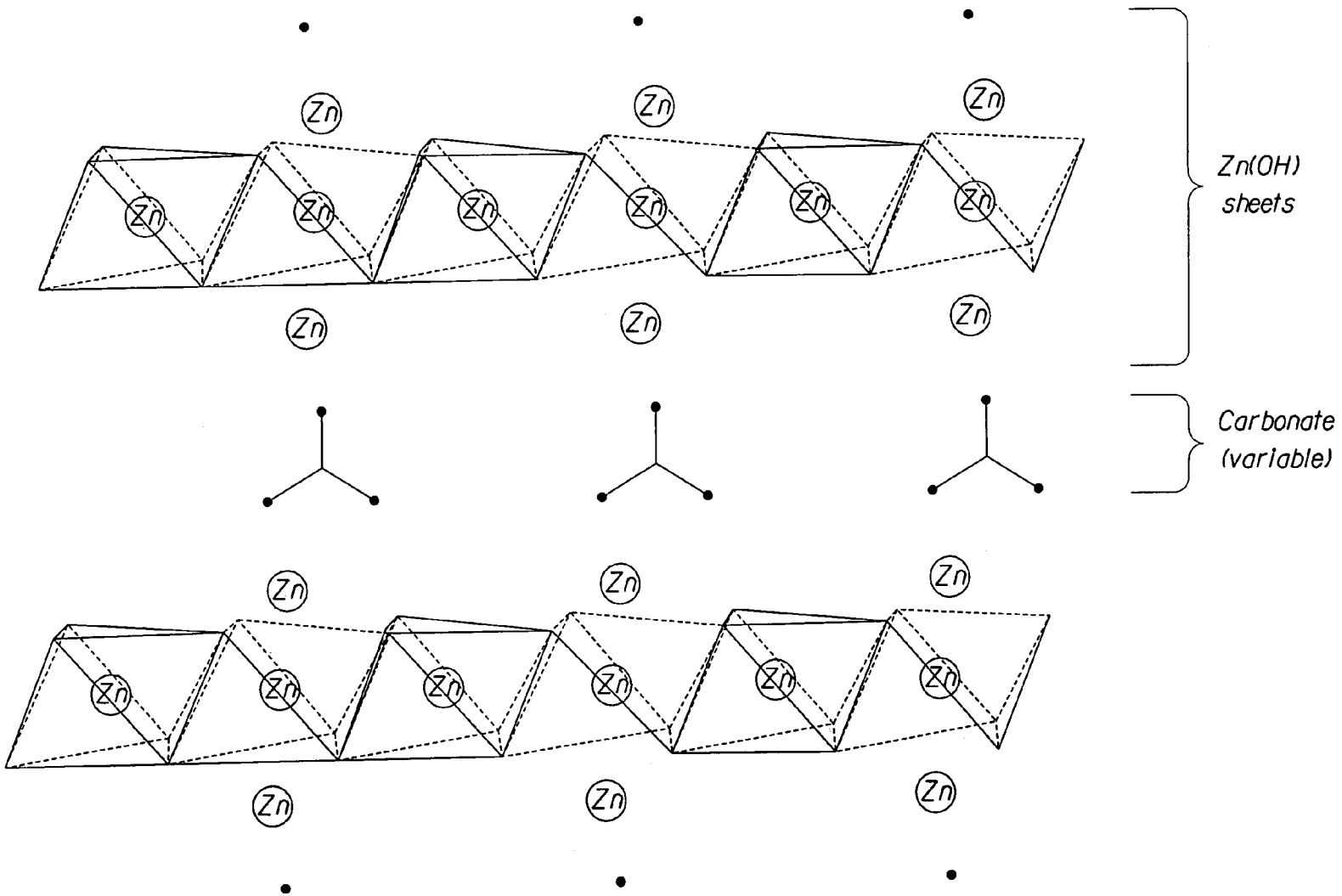

COMPOSITIONS FOR PROTECTING GLASSWARE FROM SURFACE CORROSION IN AUTOMATIC DISHWASHING APPLIANCES

FIELD OF THE INVENTION

The present invention relates to protecting glassware surfaces from corrosion using through-the-wash detergent compositions, especially detergent compositions comprising zinc-containing materials, in automatic dishwashing appliances.

BACKGROUND

Automatic dishwashing detergents constitute a generally recognized distinct class of detergent compositions whose purpose can include to break down and remove food soils; to inhibit foaming; to promote the wetting of wash articles in order to reduce or eliminate visually observable spotting and filming; to remove stains such as might be caused by beverages such as coffee and tea or by vegetable soils such as carotenoid soils; to prevent a buildup of soil films on washware surfaces; and to reduce or eliminate tarnishing of flatware without substantially etching or corroding or otherwise damaging the surface of glasses or dishes. The problem of glassware corroding during washing the cycle of an automatic dishwashing appliance has long been known. Current opinion is that the problem of corrosion in glassware is the result of two separate phenomena. On one hand, the high pH needed for cleaning causes silica hydrolysis. This dissolved silica/silicate, together with silicates added purposely to prevent china and metal corrosion, deposit on the glass surface leading to iridescence and clouding. On the other hand, builder removal of chelate metal ions from the glass surface, and the subsequent metal ion leaching that follows renders a less durable and chemical resistant glass. After several washes in an automatic dishwashing appliance, both phenomena can cause damage to glassware such as cloudiness, scratches, and streaks.

Most consumers agree that corrosion of glassware from use of detergent compositions in automatic dishwashing (ADW) is one of their most serious unmet needs. ADW detergent compositions containing zinc or magnesium salts of organic acids for improved protection against glass corrosion are known. As these salts are sparingly soluble, they are used for controlled release of reactive zinc species. The performance of soluble zinc salts in detergent compositions is difficult to control as precipitates of insoluble zinc salts with other ions in the wash liquor will occur. Yet insoluble zinc salt precipitates may deposit on both the glassware and on the ADW appliance elements itself. Furthermore, some insoluble zinc salts may be too inert to deliver the needed $Zn^{2+}$ ions, as for example zinc oxide (ZnO). Aluminum sulfate salts have also shown promise, but formulatabilty issues remain. For example, flocculation with a polymer thickener and a slight negative on oxygen bleach performance requires an encapsulation approach, which can add formulation costs. Rinse aids containing zinc or magnesium salts are also known but are used by only a small number of consumers, therefore, it is desirable to be able to deliver $Zn^{2+}$ ions through-the-wash. Thus, there is a continuing need to develop alternative automatic dishwashing detergent compositions containing $Zn^{2+}$ ions that provide the above-mentioned benefits yet reduce the problem of glassware surface corrosion experienced in through-the-wash applications.

SUMMARY OF THE INVENTION

The present invention relates to domestic, institutional, industrial, and/or commercial through-the-wash (TTW) ADW detergent compositions for protecting glassware from surface corrosion having an effective amount of certain zinc-containing materials, such as, particulate zinc-containing materials (PZCMs) and zinc-containing layered materials (ZCLMs). In accordance with one aspect, a TTW ADW detergent composition comprises: (a) an effective amount of a zinc-containing layered material, (b) a detergent active, and (c) optionally one or more of the following: a dispersant polymer or carrier medium; and (d) optionally, an adjunct ingredient. In accordance with another aspect, a treatment system is provided. The treatment system comprises a kit comprising (a) a package; (b) instructions for use; and (c) a TTW ADW detergent composition. In accordance with another aspect, a composition of matter is provided. The composition of matter comprises a wash liquor comprising a TTW ADW detergent composition comprising an effective amount of a zinc-containing layered material.

DRAWING DESCRIPTION

FIG. 1 represents a side view of the structure of a zinc-containing layered material.

DETAILED DESCRIPTION

It has surprisingly been found that glassware can be protected from corrosion by contacting glassware surfaces with a through-the-wash (TTW) ADW detergent composition containing certain zinc-containing materials, such as, particulate zinc-containing materials (PZCMs) and zinc-containing layered materials (ZCLMs). This is especially true in soft water conditions where chelating agents and builders can damage glassware by chelating metal ions in the glass structure itself. Thus, even in such harsh TTW environments, glass damage from surface corrosion can be reduced with the use of ZCLMs in ADW detergent compositions without the negative effects associated with the use of metal salts, such as: (a) increased cost of manufacture; (b) the need for higher salt levels in the formula due to poor solubility of the insoluble material; (c) the thinning of gel detergent compositions by interaction of the metal ions, for example $Al^{3+}$ ions and $Zn^{2+}$ ions, with the thickener material; or (d) a reduction in the cleaning performance for tea, stains by interfering with the bleach during the entire wash cycle. It has also surprisingly been found that the glass care benefit of the ZCLM is significantly enhanced when the ZCLM is dispersed prior to adding to or during the process of manufacturing the TTW ADW detergent composition. Achieving good dispersion of the ZCLM particles in the TTW ADW detergent composition significantly reduces agglomeration of the ZCLM particles in the wash liquor.

Any suitable TTW ADW detergent composition may be used herein, alone or in combination with a composition of matter (such as the wash liquor), and/or as part of a treatment system having an effective amount of certain zinc-containing materials, such as, PZCMs and ZCLMs. By "effective amount" herein is meant an amount that is sufficient, under the comparative test conditions described herein, to reduce glassware surface corrosion damage on treated glassware through-the-wash.

Particulate Zinc-Containing Materials (PZCMs)

Particulate zinc-containing materials (PZCMs) remain mostly insoluble within formulated compositions. Examples of PZCMs useful in certain non-limiting embodiments may include the following:

Inorganic Materials: zinc aluminate, zinc carbonate, zinc oxide and materials containing zinc oxide (i.e., calamine), zinc phosphates (i.e., orthophosphate and pyrophosphate), zinc selenide, zinc sulfide, zinc silicates (i.e., ortho- and meta-zinc silicates), zinc silicofluoride, zinc borate, zinc hydroxide and hydroxy sulfate, zinc-containing layered materials, and combinations thereof.

Natural Zinc-containing Materials/Ores and Minerals: sphalerite (zinc blende), wurtzite, smithsonite, franklinite, zincite, willemite, troostite, hemimorphite, and combinations thereof.

Organic Salts: zinc fatty acid salts (i.e., caproate, laurate, oleate, stearate, etc.), zinc salts of alkyl sulfonic acids, zinc naphthenate, zinc tartrate, zinc tannate, zinc phytate, zinc monoglycerolate, zinc allantoinate, zinc urate, zinc amino acid salts (i.e., methionate, phenylalinate, tryptophanate, cysteinate, etc), and combinations thereof.

Polymeric Salts: zinc polycarboxylates (i.e., polyacrylate), zinc polysulfate, and combinations thereof.

Physically Adsorbed Forms: zinc-loaded ion exchange resins, zinc adsorbed on particle surfaces, composite particles in which zinc salts are incorporated (i.e., as core/shell or aggregate morphologies), and combinations thereof.

Zinc Salts: zinc oxalate, zinc tannate, zinc tartrate, zinc citrate, zinc oxide, zinc carbonate, zinc hydroxide, zinc oleate, zinc phosphate, zinc silicate, zinc stearate, zinc sulfide, zinc undecylate, and the like, and combinations thereof.

Commercially available sources of zinc oxide include Z-Cote and Z-Cote HPI (BASF), and USP I and USP II (Zinc Corporation of America).

Physical Properties of PZCM Particles

Many benefits of using PZCMs in TTW ADW detergent compositions require that the $Zn^{2+}$ ion be chemically available without being soluble. This is termed "zinc lability". Certain physical properties of the PZCM have the potential to impact zinc lability. We have developed more effective TTW ADW detergent composition formulations based on optimizing PZCM zinc lability.

Some PZCM physical properties that can impact zinc lability may include, but are not limited to: crystallinity, surface area, and morphology of the particles, and combinations thereof. Other PZCM physical properties that may also impact zinc lability of PZCMs include, but are not limited to: bulk density, surface charge, refractive index, purity level, and combinations thereof.

Crystallinity

A PZCM having a less crystalline structure may result in a higher relative zinc lability. One can measure crystal imperfections or crystalline integrity of a particle by full width half maximum (FWHM) of reflections of an x-ray diffraction (XRD) pattern. Not wishing to be bound by theory, it is postulated that the larger the FWHM value, the lower the level of crystallinity in a PZCM. The zinc lability appears to increase as the crystallinity decreases. Any suitable PZCM crystallinity may be used. For example, suitable crystallinity values may range from about 0.01 to 1.00, or from about 0.1 to about 1.00, or form about 0.1 to about 0.90, or from about 0.20 to about 0.90, and alternatively, from about 0.40 to about 0.86 FWHM units at a 200 (~13° 2θ, 6.9Å) reflection peak.

Particle Size

The PZCM particles in the TTW ADW detergent composition may have any suitable average particle size. In certain non-limiting embodiment, it is has been found that a smaller particle size is directly proportional to an increase in relative zinc lability (%). Suitable average particle sizes include, but not limited to: a range of from about 10 nm to about 100 microns, or from about 10 nm to about 50 microns, or from about 10 nm to about 30 microns, or from about 10 nm to about 20 microns, or from about 10 nm to about 10 microns, and alternatively, from about 100 nm to about 10 microns. In another non-limiting embodiment, the PZCM may have an average particle size of less than about 15 microns, or less than about 10 microns, and alternatively less than about 5 microns.

Particle Size Distribution

Any suitable PZCM particle size distribution may be used. Suitable PZCM particle size distributions include, but are not limited to: a range from about 1 nm to about 150 microns, or from about 1 nm to about 100 microns, or from about 1 nm to about 50 microns, or from about 1 nm to about 30 microns, or from about 1 nm to about 20 microns, or from about 1 nm to about 10 microns, or from about 1 nm to about 1 micron, or from about 1 nm to about 500 nm, or from about 1 nm to about 100 nm, or from about 1 nm to about 50 nm, or from about 1 nm to about 30 nm, or from about 1 nm to about 20 nm, and alternatively, from about 1 nm or less, to about 10 nm.

Zinc-Containing Layered Materials (ZCLMs)

As already defined above, ZCLMs are a subclass of PZCMs. Layered structures are those with crystal growth primarily occurring in two dimensions. It is conventional to describe layer structures as not only those in which all the atoms are incorporated in well-defined layers, but also those in which there are ions or molecules between the layers, called gallery ions (A. F. Wells "Structural Inorganic Chemistry" Clarendon Press, 1975). For example, ZCLMs may have $Zn^{2+}$ ions incorporated in the layers and/or as more labile components of the gallery ions.

Many ZCLMs occur naturally as minerals. Common examples include hydrozincite (zinc carbonate hydroxide), basic zinc carbonate, aurichalcite (zinc copper carbonate hydroxide), rosasite (copper zinc carbonate hydroxide) and many related minerals that are zinc-containing. Natural ZCLMs can also occur wherein anionic layer species such as clay-type minerals (e.g., phyllosilicates) contain ion-exchanged zinc gallery ions. Other suitable ZCLMs include the following: zinc hydroxide acetate, zinc hydroxide chloride, zinc hydroxide lauryl sulfate, zinc hydroxide nitrate, zinc hydroxide sulfate, hydroxy double salts, and mixtures thereof. Natural ZCLMs can also be obtained synthetically or formed in situ in a composition or during a production process.

Hydroxy double salts can be represented by the general formula:

$$[M^{2+}{}_{1-x}M^{2+}{}_{1+x}(OH)_{3(1-y)}]^{+}A^{n-}{}_{(1=3y)/n}\cdot nH_2O$$

where the two metal ions may be different; if they are the same and represented by zinc, the formula simplifies to $[Zn_{1+x}(OH)_2]^{2x+}2x\ A^{-}.nH_2O$ (see Morioka, H., Tagaya, H., Karasu, M, Kadokawa, J, Chiba, K *Inorg. Chem.* 1999, 38, 4211-6). This latter formula represents (where x=0.4) common materials such as zinc hydroxychloride and zinc hydroxynitrate. These are related to hydrozincite as well, when a divalent anion replaces the monovalent anion.

Commercially available sources of zinc carbonate include zinc carbonate basic (Cater Chemicals: Bensenville, Ill., USA), zinc carbonate (Shepherd Chemicals: Norwood, Ohio, USA), zinc carbonate (CPS Union Corp.: New York, N.Y., USA), zinc carbonate (Elementis Pigments: Durham, UK), and zinc carbonate AC (Bruggemann Chemical: Newtown Square, Pa., USA).

The abovementioned types of ZCLMs represent relatively common examples of the general category and are not intended to be limiting as to the broader scope of materials that fit this definition.

Any suitable ZCLM in any suitable amount may be used in the TTW ADW detergent compositions described herein. Suitable amounts of a ZCLM include, but are not limited to: a range: from about 0.001% to about 20%, or from about 0.001% to about 10%, or from about 0.01% to about 7%, and alternatively, from about 0.1% to about 5% by weight of the composition.

ZCLM Glass Network Strengthening Mechanism

It is well known that silica glass is a continuous three-dimensional (3D) network of corner-shared Si—O tetrahedra-lacking symmetry and periodicity (see W. H. Zachariasen, J. Am. Chem. Soc. 54, 3841, 1932). $Si^{4+}$ ions are network forming ions. At the vertex of each tetrahedron, and shared between two tetrahedra, is an oxygen atom known as a bridging oxygen.

Mechanical glass surface properties, such as chemical resistance, thermal stability, and durability, may depend on the glassware surface structure itself. Without wishing to bound by theory, it is believed that when some network forming positions are occupied by zinc compounds or $Zn^2$+ ions, the mechanical properties of the glassware surface structure improve (see G. Calas et al. C. R. Chimie 5 2002, 831-843).

FIG. 1 depicts a zinc-containing layered structure with crystal growth primarily occurring in two dimensions. $Zn^{2+}$ ions are incorporated in the layers and/or as more labile components of the gallery ions. For example, ZCLMs, such as synthetic zinc carbonate hydroxide (ZCH) or natural-occurring hydrozincite (HZ), may have the formula:

$$3Zn(OH)_2.2ZnCO_3 \text{ or } Zn_5(OH)_6(CO_3)_2,$$

and consist of $Zn^2$+ ions forming brucite type hydroxide layers with some octahedral vacancies as shown in FIG. 1. Some of the $Zn^2$+ ions are positioned just above and below the vacant sites outside the hydroxide layers in tetrahedral (Td) coordination. Interlayer anions are weakly bound to the Td $Zn^2$+ ions completing the Td coordination. In the wash liquor, an ADW detergent composition with labile Td $Zn^2$+ ions is stable at the typical alkaline pH.

When a ZCLM is present in the wash water, the cationic charge on the brucite type hydroxide layers is the driving force for interaction with the negatively charged glass surface. This leads to efficient deposition of zinc compounds or $Zn^2$+ ions on the glass surface such that very low level of ZCLMs are needed to deliver a benefit. Once the brucite type hydroxide layers are placed in contact with the glass, zinc compounds or $Zn^2$+ ions can readily deposit on the glass and fill in the vacancies created by metal ion leaching and silica hydrolysis commonly occurring with ADW products. Thus, new zinc compounds or $Zn^2$+ ions, introduced as glass network formers, strengthen the glass and prevent glass corrosion during further washes.

TTW ADW Detergent Compositions and Compositions of Matter

The TTW ADW detergent compositions described herein provide at least some glassware surface corrosion protection to glassware surfaces when treated with the TTW ADW detergent composition during at least some portion of the wash cycle.

One non-limiting embodiment is directed to a TTW ADW detergent composition comprising an effective amount of a ZCLM such that when the ZCLM is placed in contact with the glassware surface, an amount of zinc compounds or $Zn^2$+ ions is deposited on and/or within the imperfections or vacancies in the glassware surface. For example, the treated glassware surface may have zinc compounds or $Zn^2$+ ions present from about 1 nm up to about 1 micron, or from about 1 nm to about 500 nm, or from about 1 nm to about 100 nm, or from about 1 nm to about 50 nm, or from about 1 nm to about 20 nm, and alternatively, from about 1 nm to about 10 nm above and/or below the treated glassware surface.

Another non-limiting embodiment is directed to a composition of matter comprising wash liquor, comprising a TTW ADW detergent composition comprising an effective amount of a ZCLM, in an automatic dishwashing appliance during at least a part of the wash cycle, wherein from about 0.0001 ppm to about 100 ppm, or from about 0.001 ppm to about 50 ppm, or from about 0.01 ppm to about 30 ppm, and alternatively, from about 0.1 ppm to about 10 ppm of a ZCLM may be present in the wash liquor.

Any suitable pH in an aqueous TTW ADW detergent composition containing a ZCLM may be used herein. In certain embodiments, a suitable pH may fall anywhere within the range of from about 6.5 to about 14. For example, certain embodiments of the TTW ADW detergent composition have a pH of greater than or equal to about 6.5, or greater than or equal to about 7, or greater than or equal to about 9, and alternatively, greater than or equal to about 10.0.

Detergent Actives

Any suitable detergent active in any suitable amount or form may be used in the TTW ADW detergent compositions. Suitable detergent actives include, but are not limited to: surfactants, suds suppressors, builder systems, bleaching systems, enzymes, and mixtures thereof.

Surfactants

The TTW ADW detergent compositions described herein may comprise one or more suitable surfactants, optionally in a surfactant system, in any suitable amount or form. Suitable surfactants include anionic surfactants, cationic surfactants, nonionic surfactants, amphoteric surfactants, ampholytic surfactants, zwitterionic surfactants, and mixtures thereof. For example, a mixed surfactant system may comprise one or more different types of the above-described surfactants.

Suitable anionic surfactants for use herein include, but are not limited to: alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, or $C_{10}$-$C_{18}$ linear or branched. Suitable cationic surfactants include, but are not limited to: chlorine esters and mono $C_6$-$C_{16}$ N-alkyl or alkenyl ammonium surfactants, wherein the remaining N positions are substituted by methyl, hydroxyethyl or hydroxypropyl groups. Suitable nonionic surfactants include, but are not limited to: low and high cloud point surfactants, and mixtures thereof. Suitable amphoteric surfactants include, but are not limited to: the $C_{12}$-$C_{20}$ alkyl amine oxides (for example, lauryldimethyl amine oxide and hexadecyl dimethyl amine oxide), and alkyl amphocarboxylic surfactants, such as MIRANOL® C2M. Suitable zwitterionic surfactants include, but are not limited to: betaines and sultaines; and mixtures thereof. Surfactants suitable for use are disclosed, for example, in U.S. Pat. Nos. 3,929,678; 4,223,163; 4,228,042; 4,239,660; 4,259,217; 4,260,529; and 6,326,341; EP Pat. No. 0414 549, EP Pat. No. 0,200,263, PCT Pub. No. WO 93/08876 and PCT Pub. No. WO 93/08874.

Suitable nonionic surfactants also include, but are not limited to low-foaming nonionic (LFNI) surfactants. A LFNI surfactant is most typically used in an TTW ADW detergent composition because of the improved water-sheeting action (especially from glassware) which they confer to the TTW ADW product. They also may encompass non-silicone, phosphate or nonphosphate polymeric materials which are known to defoam food soils encountered in automatic dishwashing. The LFNI surfactant may have a relatively low cloud point and a high hydrophilic-lipophilic balance (HLB). Cloud points of 1% solutions in water are typically below about 32° C. and alternatively lower, e.g., 0° C., for optimum control of sudsing throughout a full range of water temperatures. If desired, a biodegradable LFNI surfactant having the above properties may be used.

A LFNI surfactant may include, but is not limited to: alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof. Polymeric compounds made from a sequential ethoxylation and propoxylation of initiator compounds with a single reactive hydrogen atom, such as $C_{12-18}$ aliphatic alcohols, do not generally provide satisfactory suds control in TTW ADW detergent compositions. However, certain of the block polymer surfactant compounds designated as PLURONIC® and TETRONIC® by the BASF-Wyandotte Corp., Wyandotte, Mich., are suitable in TTW ADW detergent compositions.

The LFNI surfactant can optionally include a propylene oxide in an amount up to about 15% by weight. Other LFNI surfactants can be prepared by the processes described in U.S. Pat. No. 4,223,163. The LFNI surfactant may also be derived from a straight chain fatty alcohol containing from about 16 to about 20 carbon atoms ($C_{16}$-$C_{20}$ alcohol), alternatively a $C_{1-8}$ alcohol, condensed with an average of from about 6 to about 15 moles, or from about 7 to about 12 moles, and alternatively, from about 7 to about 9 moles of ethylene oxide per mole of alcohol. The ethoxylated nonionic surfactant so derived may have a narrow ethoxylate distribution relative to the average.

In certain embodiments, a LFNI surfactant having a cloud point below 30° C. may be present in an amount from about 0.01% to about 60%, or from about 0.5% to about 10% by weight, and alternatively, from about 1% to about 5% by weight of the composition.

Suds Suppressor

Any suitable suds suppressor in any suitable amount or form may be used. Suds suppressors suitable for use may be low foaming and include low cloud point nonionic surfactants (as discussed above) and mixtures of higher foaming surfactants with low cloud point nonionic surfactants which act as suds suppressors therein (see PCT Pub. No. WO 93/08876; EP Pat. No. 0705324, U.S. Pat. Nos. 6,593,287, 6,326,341 and 5,576,281. In certain embodiments, one or more suds suppressors may be present in an amount from about 0% to about 30% by weight, or about 0.2% to about 30% by weight, or from about 0.5% to about 10%, and alternatively, from about 1% to about 5% by weight of composition.

Builder System

Any suitable builder system comprising any suitable builder in any suitable amount or form may be used. Any conventional builder is suitable for use herein. For example, suitable builders include, but are not limited to: citrate, phosphate (such as sodium tripolyphosphate, potassium tripolyphosphate, mixed sodium and potassium tripolyphosphate, sodium or potassium or mixed sodium and potassium pyrophosphate), aluminosilicate materials, silicates, polycarboxylates and fatty acids, materials such as ethylenediamine tetraacetate, metal ion sequestrants such as aminopolyphosphonates, ethylenediamine tetramethylene phosphonic acid and diethylene triamine pentamethylenephosphonic acid.

Examples of other suitable builders are disclosed in the following patents and publications: U.S. Pat. Nos. 3,128,287; 3,159,581; 3,213,030; 3,308,067; 3,400,148; 3,422,021; 3,422,137; 3,635,830; 3,835,163; 3,923,679; 3,985,669; 4,102,903; 4,120,874; 4,144,226; 4,158,635; 4,566,984; 4,605,509; 4,663,071; and 4,663,071; German Patent Application No. 2,321,001 published on Nov. 15, 1973; European Pat. No. 0,200,263; Kirk Othmer, 3rd Edition, Vol. 17, pp. 426-472 and in "Advanced Inorganic Chemistry" by Cotton and Wilkinson, pp. 394-400 (John Wiley and Sons, Inc.; 1972).

Enzyme

Any suitable enzyme and/or enzyme stabilizing system in any suitable amount or form may be used. Enzymes suitable for use include, but are not limited to: proteases, amylases, lipases, cellulases, peroxidases, and mixtures thereof. Amylases and/or proteases are commercially available with improved bleach compatibility. In practical terms, the TTW ADW detergent composition may comprise an amount up to about 5 mg, more typically about 0.01 mg to about 3 mg by weight, of active enzyme per gram of the composition. Protease enzymes are usually present in such commercial preparations at levels sufficient to provide from 0.005 to 0.1 Anson units (AU) of activity per gram of composition, or 0.01%-1% by weight of a commercial enzyme preparation.

For automatic dishwashing purposes, it may be desirable to increase the active enzyme content in order to reduce the total amount of non-catalytically active materials delivered and thereby improve anti-spoting/anti-filming results. In certain embodiments, enzyme-containing TTW ADW detergent compositions, especially liquid, liquid gel, and gel compositions, may comprise from about 0.0001% to about 10%, or from about 0.005% to about 8%, or from about 0.01% to about 6%, by weight of an enzyme stabilizing system. The enzyme stabilizing system can be any stabilizing system that is compatible with the detersive enzyme. Such stabilizing systems can include, but are not limited to: calcium ions, boric acid, propylene glycol, short chain carboxylic acid, boronic acid, and mixtures thereof.

Bleaching System

Any suitable bleaching agent or system in any suitable amount or form may be used. Bleaching agents suitable for use include, but are not limited to: chlorine and oxygen bleaches. In certain embodiments, a bleaching agent or system may be present in an amount from about 0% to about 30% by weight, or about 1% to about 15% by weight, or from about 1% to about 10% by weight, and alternatively from about 2% to about 6% by weight of composition.

Suitable bleaching agents include, but are not limited to: inorganic chlorine (such as chlorinated trisodium phosphate), organic chlorine bleaches (such as chlorocyanurates, water-soluble dichlorocyanurates, sodium or potassium dichloroisocyanurate dihydrate, sodium hypochlorite and other alkali metal hypochlorites); inorganic perhydrate salts (such as sodium perborate mono-and tetrahydrates and sodium percarbonate, which may be optionally coated to provide controlled rate of release as disclosed in UK Pat. No. GB 1466799 on sulfate/carbonate coatings), preformed organic peroxyacids, and mixtures thereof.

Peroxygen bleaching compounds can be any peroxide source comprising sodium perborate monohydrate, sodium perborate tetrahydrate, sodium pyrophosphate peroxyhydrate, urea peroxyhydrate, sodium percarbonate, sodium peroxide, and mixtures thereof. In other non-limiting embodiments, peroxygen-bleaching compounds may comprise sodium perborate monohydrate, sodium perborate tetrahydrate, sodium percarbonate, and mixtures thereof.

The bleaching system may also comprise transition metal-containing bleach catalysts, bleach activators, and mixtures thereof. Bleach catalysts suitable for use include, but are not limited to: the manganese triazacyclononane and related complexes (see U.S. Pat. Nos. 4,246,612, 5,227,084); Co, Cu, Mn and Fe bispyridylamine and related complexes (see U.S. Pat. No. 5,114,611); and pentamine acetate cobalt (III) and related complexes (see U.S. Pat. No. 4,810,410) at levels from 0% to about 10.0%, by weight; and alternatively, from about 0.0001% to about 1.0%.

Typical bleach activators suitable for use include, but are not limited to: peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP Pat. No. 0170386); and benzoxazin peroxyacid precursors (EP Pat. No. 0332294 and EP Pat. No. 0482807) at levels from 0% to about 10.0%, by weight; or from 0.1% to 1.0%.

Other bleach activators include to substituted benzoyl caprolactam bleach activators and their use in bleaching systems and detergents. The substituted benzoyl caprolactams have the formula:

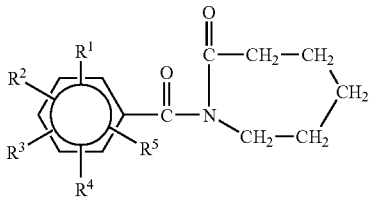

wherein $R^1$, $R^2$, $R^3$, $R^4$, and $R^5$ contain from 1 to 12 carbon atoms, or from 1 to 6 carbon atoms and are members selected from the group consisting of H, halogen, alkyl, alkoxy, alkoxyaryl, alkaryl, alkaryloxy, and members having the structure:

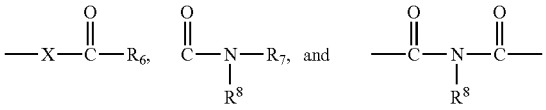

wherein $R_6$ is selected from the group consisting of H, alkyl, alkaryl, alkoxy, alkoxyaryl, alkaryloxy, and aminoalkyl; X is O, NH, or $NR_7$, wherein $R_7$ is H or a $C_1$-$C_4$ alkyl group; and $R_8$ is an alkyl, cycloalkyl, or aryl group containing from 3 to 11 carbon atoms; provided that at least one R substituent is not H. The $R^1$, $R^2$, $R^3$, and $R^4$ are H and $R^5$ may be selected from the group consisting of methyl, methoxy, ethyl, ethoxy, propyl, propoxy, isopropyl, isopropoxy, butyl, tert-butyl, butoxy, tert-butoxy, pentyl, pentoxy, hexyl, hexoxy, Cl, and $NO_3$. Alternatively, $R^1$, $R^2$, $R^3$ are H, and $R^4$ and $R^5$ may be selected from the group consisting of methyl, methoxy, and Cl.

Adjunct Ingredients

Any suitable adjunct ingredient in any suitable amount or form may be used. Suitable adjunct ingredients include, but are not limited to: other cleaning agents (e.g. surfactants, cosurfactants), chelating agents, sequestrants, alkalinity sources, water softening agents, secondary solubility modifiers, thickeners, acids, soil release polymers, dispersant polymers, hydrotropes, binders, carrier mediums, antibacterial actives, detergent fillers, abrasives, defoamers, anti-redeposition agents, threshold agents or systems, aesthetic enhancing agents (i.e., dyes, colorants, perfumes, etc.), oils, solvents, and mixtures thereof.

Dispersant Polymer

Any suitable dispersant polymer in any suitable amount may be used. Unsaturated monomeric acids that can be polymerized to form suitable dispersant polymers (e.g. homopolymers, copolymers, or terpolymers) include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. may be suitable provided that such segments do not constitute more than about 50% by weight of the dispersant polymer. Suitable dispersant polymers include, but are not limited to those disclosed in U.S. Pat. Nos. 3,308,067; 3,308,067; and 4,379,080.

Substantially non-neutralized forms of the polymer may also be used in the TTW ADW detergent compositions. The molecular weight of the polymer can vary over a wide range, for instance from about 1000 to about 500,000, alternatively from about 1000 to about 250,000. Copolymers of acrylamide and acrylate having a molecular weight of from about 3,000 to about 100,000, or from about 4,000 to about 20,000, and an acrylamide content of less than about 50%, and alternatively, less than about 20%, by weight of the dispersant polymer can also be used. The dispersant polymer may have a molecular weight of from about 4,000 to about 20,000 and an acrylamide content of from about 0% to about 15%, by weight of the polymer. Suitable modified polyacrylate copolymers include, but are not limited to the low molecular weight copolymers of unsaturated aliphatic carboxylic acids disclosed in U.S. Pat. Nos. 4,530,766, and 5,084,535; and European Patent No. 0,066,915.

Other suitable dispersant polymers include polyethylene glycols and polypropylene glycols having a molecular weight of from about 950 to about 30,000, which can be obtained from the Dow Chemical Company of Midland, Mich. Such compounds for example, having a melting point within the range of from about 30° C. to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective and polypropylene glycol. The polyethylene, polypropylene and mixed glycols are referred to using the formula:

$$HO(CH_2CH_2O)_m(CH_2CH(CH_3)O)_n(CH(CH_3)CH_2O)_{OH}$$

wherein m, n, and o are integers satisfying the molecular weight and temperature requirements given above.

Suitable dispersant polymers also include the polyaspartate, carboxylated polysaccharides, particularly starches, celluloses and alginates, described in U.S. Pat. No. 3,723,322; the dextrin esters of polycarboxylic acids disclosed in U.S. Pat. No. 3,929,107; the hydroxyalkyl starch ethers, starch esters, oxidized starches, dextrins and starch hydrolysates described in U.S. Pat. No. 3,803,285; the carboxylated starches described in U.S. Pat. No. 3,629,121; and the dextrin starches described in U.S. Pat. No. 4,141,841. Suitable cellulose dispersant polymers, described above, include, but are not limited to: cellulose sulfate esters (for example, cellulose acetate sulfate, cellulose sulfate, hydroxyethyl cellulose sulfate, methylcellulose sulfate, hydroxypropylcellulose sulfate, and mixtures thereof), sodium cellulose sulfate, carboxymethyl cellulose, and mixtures thereof.

In certain embodiments, a dispersant polymer may be present in an amount in the range from about 0.01% to about 25%, or from about 0.1% to about 20%, and alternatively, from about 0.1% to about 7% by weight of the composition.

Carrier Medium

Any suitable carrier medium in any suitable amount in any suitable form may be used. Suitable carrier mediums include both liquids and solids depending on the form of the TTW ADW detergent composition desired. A solid carrier medium may be used in dry powders, granules, tablets, encapsulated products, and combinations thereof. Suitable solid carrier mediums include, but are not limited to carrier mediums that are non-active solids at ambient temperature. For example, any suitable organic polymer, such as polyethylene glycol (PEG), may be used. In certain embodiments, the solid carrier medium may be present in an amount in the range from about 0.01% to about 20%, or from about 0.01% to about 10%, and alternatively, from about 0.01% to about 5% by weight of the composition.

Suitable liquid carrier mediums include, but are not limited to: water (distilled, deionized, or tap water), solvents, and mixtures thereof. The liquid carrier medium may be present in an amount in the range from about 1% to about 90%, or from about 20% to about 80%, and alternatively, from about 30% to about 70% by weight of the aqueous composition. The liquid carrier medium, however, may also contain other materials which are liquid, or which dissolve in the liquid carrier medium at room temperature, and which may also serve some other function besides that of a carrier. These materials include, but are not limited to: dispersants, hydrotropes, and mixtures thereof.

The TTW ADW composition can be provided in a "concentrated" system. For example, a concentrated liquid composition may contain a lower amount of a suitable carrier medium, compared to conventional liquid compositions. Suitable carrier medium content of the concentrated system may be present in an amount from about 30% to about 99.99% by weight of the concentrated composition. The dispersant content of the concentrated system may be present in an amount from about 0.001% to about 10% by weight of the concentrated composition.

Product Form

Any suitable product form may be used. Suitable product forms include, but not limited to: solids, granules, powders, liquids, gels, pastes, semi-solids, tablets, water-soluble pouches, and combinations thereof. The TTW ADW detergent composition may also be packaged in any suitable form, for example, as part of a treatment system comprising a kit, which may comprise (a) a package; (b) a through-the-wash automatic dishwashing detergent composition comprising an effective amount of a zinc-containing layered material; (c) a detergent active; (d) optionally, an adjunct ingredient; and (e) instructions for using the TTW ADW detergent composition to reduce glassware surface corrosion. The TTW ADW detergent composition, as part of the treatment system, may be formulated in a single- and/or multi-compartment water-soluble pouch so that negative interactions with other components are reduced.

The TTW ADW detergent composition suitable for use herein can be dispensed from any suitable device, including but not limited to: dispensing baskets or cups, bottles (pump assisted bottles, squeeze bottles, etc.), mechanic pumps, multi-compartment bottles, capsules, multi-compartment capsules, paste dispensers, and single- and multi-compartment water-soluble pouches, and combinations thereof. For example, a multi-phase tablet, a water-soluble or water-dispersible pouch, and combinations thereof, may be used to deliver the TTW ADW detergent composition to any suitable solution or substrate. Suitable solutions and substrates include but are not limited to: hot and/or cold water, wash and/or rinse liquor, hard surfaces, and combinations thereof. The multi-phase product may be contained in a single or multi-compartment, water-soluble pouch. In certain embodiments, a TTW ADW detergent composition may comprise a unit dose which allows for the controlled release (for example delayed, sustained, triggered, or slow release). The unit dose may be provided in any suitable form, including but not limited to: tablets, single- and multi-compartment water-soluble pouch, and combinations thereof. For example, the TTW ADW detergent composition may be provided as a unit dose in the form of a multi-phase product comprising a solid (such as a granules or tablet) and a liquid and/or gel separately provided in a multi-compartment water-soluble pouch.

Process of Manufacture

Any suitable process having any number of suitable process steps may be used to manufacture the TTW ADW detergent composition in any suitable form (e.g. solids, liquids, gels). The TTW ADW detergent composition, disclosed herein, may be formulated with any suitable amount of ZCLM in any suitable form. The TTW ADW detergent composition may include a ZCLM that is manufactured in the form of a powder, granule, crystal, core particle, aggregate of core particles, agglomerate, particle, flake, extrudate, prill, or as a composite (e.g. in the form of a composite particle, flake, extrudate, prill), and combinations thereof. The ZCLM may be nonfriable, water-soluble or water-dispersible and/or may dissolve, disperse and/or melt in a temperature range of from about 20° C. to about 70° C.

It has been surprisingly found that by incorporating a ZCLM comprising a dispersant polymer and/or carrier medium into one of the above-mentioned composite forms (such as, a composite particle, prill, flake and/or extrudate), a significant improvement in glassware surface corrosion protection performance is observed, especially for TTW ADW detergent compositions and/or products in the form of granules, powders, tablets, solids placed in water-soluble pouches, and combinations thereof. A composite particle, prill, flake and/or extrudate may be made separately by mixing raw ZCLM particles in powder form with an adjunct ingredient (such as, a dispersant polymer and/or carrier medium) in any order. Using the composite particle, prill, flake and/or extrudate containing the ZCLM reduces segregation or the tendency of the ZCLM particles to settle or agglomerate in the TTW ADW detergent composition or final product. Furthermore, an enhancement of the dispersion of ZCLM particles in the wash liquor is observed once the composite particle, prill, flake and/or extrudate are delivered via the TTW ADW detergent composition during the wash cycle. It has also been observed that by delivering an increased dispersion of the ZCLM particles in the wash liquor, a significant improvement in the glasscare surface corrosion protection performance occurs when compared to using raw ZCLM particles directly in a detergent composition (such as, with the use of a commercially available ZCLM) at equal levels, without incorporating a dispersant polymer and/or carrier medium into one of the above-mentioned composite forms.

When the above-mentioned composite particle, prill, flake and/or extrudate comprises a one or more carrier components, the carrier component(s) may be heated to above their melting point before adding the desired components (such as for example, a ZCLM, a detergent active, and/or an adjunct ingredient). Carrier components suitable for preparing a solidified melt are typically non-active components that can be heated to above melting point to form a liquid, and are cooled to form an intermolecular matrix that can effectively trap the desired components.

The ZCLM can also be incorporated into a powder, granule, tablets and/or solids placed in water-soluble pouch formulations by spraying a liquid mixture, comprising a ZCLM and a liquid carrier, onto solid base detergent granules. The liquid carrier can be, for example, water, solvent, surfactant, and/or any other suitable liquid whereby the ZCLM can be dispersed. The above-mentioned spraying step may occur at any suitable time during the TTW ADW detergent composition manufacturing process. For example, a spraying step may occur during a hydration step should one of the detergent actives (such as, phosphate) require hydration before spraying or admixing. The spraying step may also occur before and/or after the mixing steps of other detergent components, and/or after the TTW ADW detergent composition is made (such as, a coating to a tablet).

In certain embodiments, a liquid TTW ADW detergent composition can be made by directly mixing and/or dispersing raw ZCLM particles in the liquid composition, during any part of manufacturing process. The ZCLM can also be dispersed into water (and/or solvent) prior to the addition of other desired components. When a liquid TTW ADW detergent composition is placed in a dispenser, such as a bottle or water-soluble pouch, sufficient dispersion of the ZCLM can be achieved in the liquid by stabilizing the ZCLM in the TTW ADW composition, either alone or in combination with a suitable adjunct ingredient, without the need to make the above-mentioned composite particle, prill, flake and/or extrudate.

One non-limiting embodiment of the process includes the steps of forming a premixture of a ZCLM by mixing an effective amount of a ZCLM in a liquid carrier (such as, water, solvent, and/or nonionic surfactant) and spraying the premixture onto solid detergent base granules. Optionally, one or more detergent actives or adjunct ingredients may be added and/or dispersed in any order to the aqueous premixture before the spraying step.

Another non-limiting embodiment comprises the process steps of mixing an effective amount of ZCLM into a molten carrier medium (such as polyethylene glycol), and spraying the molten mixture onto solid detergent base granules, powders and/or tablets. Another alternative, especially for granules, powders, tablets, and/or solids placed in water-soluble pouches, is to allow the above-described molten mixture to cool to a solid before grinding to a desired particle size and form (such as, a composite particle, prill, or flake). Optionally, one or more detergent actives or adjunct ingredients, in powder form, may be added in any order to the molten carrier medium before the cooling step. The molten mixture can also be extruded to form an extrudate composite, then cooled and ground to a desired form and particle size, if necessary, and mixed as described above. The ground mixtures can then be dispersed into the TTW ADW detergent composition in any one or more of the above-mentioned forms to promote optimized corrosion protection performance.

EXAMPLES

The following examples of TTW ADW detergent compositions are provided for purposes of showing certain embodiments, and as such are not intended to be limiting in any manner.

Liquid/Gel TTW ADW Detergent Composition

| | EXAMPLES | | | | | |
|---|---|---|---|---|---|---|
| Ingredients | 1 | 2 | 3 | 4 | 5 | 6 |
| STPP/SKTP/KTPP | 17.5 | 17.5 | 17.5 | 17.5 | 22.0 | 22.0 |
| ZCLM | — | 0.05 | 0.1 | 0.5 | 0.1 | 0.2 |
| Sodium hydroxide | 1.9 | 1.9 | 1.9 | 1.9 | — | — |
| Potassium hydroxide | 3.9 | 3.9 | 3.9 | 3.9 | 5.8 | 5.8 |
| Sodium silicate | 7.0 | 7.0 | 7.0 | 7.0 | — | — |
| H2SO4 | — | — | — | — | 3.9 | 3.9 |
| Thickener | 1.0 | 1.0 | 1.0 | 1.0 | 1.2 | 1.2 |
| Sodium hypochlorite | 1.2 | 1.2 | 1.2 | 1.2 | — | — |
| Nonionic surfactant | — | — | — | — | 1.0 | 1.0 |
| Protease enzyme | — | — | — | — | 0.6 | 0.6 |
| Amylase enzyme | — | — | — | — | 0.2 | 0.2 |
| Enzyme stabilizing agents | — | — | — | — | 3.5 | 3.5 |
| Dye/perfume/speckles/water | Balance | Balance | Balance | Balance | Balance | Balance |

Granular or Powder TTW ADW Detergent Composition

| Ingredients | EXAMPLES 7 | 8 | 9 | 10 | 11 | 12 | 13 |
|---|---|---|---|---|---|---|---|
| STPP/SKTP/KTPP | 23.0 | 23.0 | 23.0 | 23.0 | 23.0 | 28.0 | — |
| Sodium citrate | — | — | — | — | — | — | 25 |
| ZCLM | — | 0.05 | 0.10 | 0.15 | 0.5 | 0.1 | 0.1 |
| Sodium carbonate | 30.0 | 30.0 | 30.0 | 30.0 | 30.0 | 30.0 | 30.0 |
| Sodium silicate | 5.5 | 5.5 | 5.5 | 5.5 | 5.5 | 5.5 | 5.5 |
| NI Ionic surfactant | 0.9 | 0.9 | 0.9 | 0.9 | 0.9 | 1.8 | 0.9 |
| Dispersant polymer | — | — | — | | | 3.3 | |
| PB1 | 4.3 | 4.3 | 4.3 | 4.3 | 4.3 | 4.3 | 4.3 |
| Catalyst (activator) | 0.004 | 0.004 | 0.004 | 0.004 | 0.004 | 0.004 | 0.004 |
| Protease enzyme | 0.6 | 0.6 | 0.6 | 0.6 | 0.6 | 1.0 | 0.25 |
| Amylase enzyme | 0.2 | 0.2 | 0.2 | 0.2 | 0.2 | 0.2 | 0.13 |
| Dye/perfume/speckles/filler/water | Balance | Balance | Balance | Balance | Balance | Balance | Balance |

Tablet/Water-Soluble Pouch TTW ADW Detergent Composition

| Ingredients | EXAMPLES 14 | 15 | 16 | 17 | 18 |
|---|---|---|---|---|---|
| STPP/SKTP/KTPP | 33.0 | 33.0 | 33.0 | 33.4 | 30.7 |
| Sodium citrate | — | — | — | — | 33.6 |
| ZCLM | — | 0.1 | 0.1 | 0.1 | 0.1 |
| Sodium carbonate | 19.0 | 19.0 | 28.0 | 26.0 | — |
| Sodium silicate | 7.8 | 7.8 | 4.2 | 4.3 | — |
| NI Ionic surfactant | 3.2 | 3.2 | 6.5 | 2.3 | 0.5 |
| Dispersant polymer | — | — | 4.3 | — | — |
| NaDCC/sodium hypochloride | | | | 1.1 | — |
| PB1 | 12.8 | 12.8 | 9.3 | — | — |
| Catalyst (activator) | 0.013 | 0.013 | 1.4 | — | — |
| Protease enzyme | 2.2 | 2.2 | 0.3 | — | 1.3 |
| Amylase enzyme | 1.7 | 1.7 | 0.9 | — | 0.2 |
| Dye/perfume/speckles/filler/Water | Balance | Balance | Balance | Balance | Balance |

TEST RESULTS

Tests 1-3 are run under the same conditions using the same or similar substrates (e.g. glasses, glass slides, and/or plates) unless otherwise noted. In each test, the substrate is washed for 50 to 100 cycles in a General Electric Model GE2000 automatic dishwasher under the following washing conditions: 0 gpg water–130° F., regular wash cycle, with the heated dry cycle turned on. On the top rack of the GE 2000, the following substrates are placed: four (4) Libbey 53 non-heat treated 10 oz. Collins glasses; three (3) Libbey 8564SR Bristol Valley 8½ oz. White Wine Glasses; three (3) Libbey 139 13 oz. English Hi-Ball Glasses; three (3) Luminarc Metro 16 oz. Coolers or 12 oz. Beverage glasses (use one size only per test); one (1) Longchamp Cristal d'Arques 5¾ oz. wine glass; and one (1) Anchor Hocking Pooh (CZ84730B) 8 oz. juice glass (when there are I or more designs per box—use only one design per test). On the bottom rack of the GE 2000, the following substrates are placed: two (2) Libbey Sunray No.15532 dinner plates 9¼ in.; and two (2) Gibson black stoneware dinner plates #3568DP (optional—if not used replace with 2 ballast dinner plates).

All the glasses and/or plates are visually graded for iridescence after washing and drying using a 1-5 grading scale (outlined below). All the glasses and/or plates are also visually graded for evidence of etching using the same 1-5 grading scale used in the iridescence test. The values of grading scale are as follows: "1" indicates very severe damage to the substrate; "2" indicates severe damage to the substrate; "3" indicates some damage to the substrate; "4" indicates very slight damage to the substrate; and "5" indicates no damage to the substrate.

Test 1

Various forms (i.e. liquid-gel, powder or granular, tablet or water soluble pouch) of various detergent compositions, containing an effective amount of a ZCLM, are used and compared to the same form of these detergent compositions without a ZCLM. The results of these tests are presented in Tables I-VI. The test results show significant glassware corrosion benefit protection is provided by the presence of an effective amount of ZCLM in TTW ADW detergent compositions.

Iridescence Test Results—Tables I-III represent a comparison of substrate iridescence.

TABLE I

Iridescence of glass substrates washed 100 cycles with Liquid Gel products:

| Substrate | Liquid Gel (Ex. 1) without ZCLM | Liquid Gel (Ex. 3) with 0.1% ZCLM (e.g. ZCH) |
|---|---|---|
| Libbey 53 (avg. of 4 glasses) | 1 | 5 |
| B. Valley wine glass | 1 | 5 |
| Luminarc Metro (avg. of 3 glasses) | 1 | 5 |
| LC Wine glass | 1 | 5 |
| Sunray plate (avg. of 2 plates) | 1 | 5 |

TABLE II

Iridescence of glass substrates washed 50 cycles with powder products:

| Substrate | Powder (Ex. 7) without ZCLM | Powder (Ex. 9) with 0.1% ZCLM (e.g. ZCH) |
|---|---|---|
| English Hi-Ball (avg. of 3 glasses) | 4 | 4 |
| B. Valley Wine glass | 5 | 5 |
| Luminarc Metro (avg. of 3 glasses) | 4 | 5 |
| Sunray plate (avg. of 2 plates) | 4 | 5 |

TABLE III

Iridescence of glass substrates washed 50 cycles with Liquid Gel products:

| Substrate | Liquid gel (Ex. 1) without ZCLM | Liquid gel (Ex. 3) with 0.1% ZCLM (e.g. zinc hydroxy sulfate) |
|---|---|---|
| English Hi-Ball (avg. of 3 glasses) | 3 | 5 |
| Luminarc Metro (avg. of 3 glasses) | 3 | 5 |
| Sunray plate (avg. of 2 plates) | 3 | 5 |

Etching Test Results—Tables IV-V represent a comparison of etching grades.

TABLE IV

Etching of glass substrate washed 50 cycles with liquid gel:

| Substrate | Liquid Gel (Ex. 1) without ZCLM | Liquid gel (Ex. 3) with 0.1% ZCLM (e.g. ZCH) |
|---|---|---|
| Libby # 53 (avg. of 4 glasses) | 2.9 | 4.3 |
| English Hi-Ball (avg. of 3 glasses) | 2.3 | 3.0 |
| B V Wine (avg. of 3 glasses) | 4.0 | 5.0 |
| Luminarc Metro (avg. of 3 glasses) | 2.0 | 3.3 |
| Sunray plate (avg. of 2 plates) | 2.8 | 4.0 |

TABLE V

Etching of glass substrate washed 50 cycles with powder products:

| Substrate | Powder (Ex. 7) without ZCLM | Powder (Ex. 9) with 0.1% ZCLM (e.g. ZCH) |
|---|---|---|
| Libby #53 (avg. of 4 glasses) | 2.3 | 3.5 |
| English Hi-Ball (avg. of 3 glasses) | 2.5 | 3.5 |
| B. Valley Wine glass | 4.3 | 4.8 |
| Luminarc Metro (avg. of 3 glasses) | 2.3 | 3.8 |

TABLE VI

Etching of glass substrate washed 50 cycles with liquid gel:

| Substrate | Liquid Gel (Ex. 1) without ZCLM | Liquid gel (Ex. 3) with 0.1% ZCLM (e.g. zinc hydroxy sulfate) |
|---|---|---|
| English Hi-Ball (avg. of 3 glasses) | 2 | 3.3 |
| Luminarc Metro (avg. of 3 glasses) | 2.3 | 3.7 |

It is observed that even a small amount of ZCLM (e.g. 0.1% ZCH and/or 0.1% zinc hydroxy sulfate) is sufficient to provide substantial anti-etching benefits to a treated glassware surface. The addition of about 0.1% of a ZCLM (such as ZCH or zinc hydroxy sulfate) in TTW ADW detergent compositions provides about 6-7 ppm of a ZCLM (as active zinc or $Zn^{2}$+ ions) in the wash liquor.

Test 2

The following 50 cycle test results show improved performance on glasscare using a ZCH powder versus a dispersed ZCLM composite particle (comprising PEG 8000 and ZCH) admixed to the TTW ADW detergent composition during the process of manufacture. The test results are summarized in Table VII.

TABLE VII

Dispersion Correlation - Etching of glass after 50 cycles with Powder

| Substrate | Powder (Ex. 9) with 0.1% ZCLM (e.g. ZCH) | Powder (Ex. 9) with 0.1% Active ZCLM (e.g. ZCH) in ZCLM Composite Particle* |
|---|---|---|
| English Hi-Ball (avg. 3 glasses) | 3.5 | 5.0 |
| Luminarc Metro (avg. 3 glasses) | 3.8 | 5.0 |

*A ZCLM composite particle in the amount of 0.28% by weight of the composition was used.

The ZCLM composite particle contains 35.1% ZCH, 3.5% blue dye solution, 1.4% bleach catalyst, and 60% PEG8000.

It is observed that significant glasscare benefit is achieved by incorporating the ZCH material into a dispersant polymer and/or carrier medium.

Test 3

A comparison is made between the 50 cycle test of Test 2 versus an extended, multi-variant test is performed combining multi-cycling and immersion techniques using different particle sizes. Test conditions for the test are as follows: a GE2000 machine is used with the main wash cycle manually disabled and extended to 23 hrs continuous washing followed by the regular rinse and drying cycles. Wash time for the first washing period is about 24 hrs. In the second washing period, this process is immediately repeated once on the same set of glasses after the addition of a new charge of detergent composition and wash water. Total wash time for both washing periods is about 48 hrs. Soft water (0-1 gpg) is used. An external heating element is built into the machine with a temperature controller to maintain the wash temperature at 150° F. throughout the continuous main wash cycle (immersion). At the end of the second 24 hr washing period, the glasses are dried, graded in a light box and photographed. The test results are summarized in Table VIII.

TABLE VIII

Particle Size Correlation - Etching of glass after 50 cycles with Powder

| Substrate | Powder (Ex. 9) with 0.1% ZCLM (e.g. ZCH) with ZCLM mean particle size of about 5–6 microns | | Powder (Ex. 9) with milled 0.1% ZCLM (e.g. ZCH) with ZCLM mean particle size of about 700 nm | |
|---|---|---|---|---|
| | 50 Cycles | 48 Hour | 50 Cycles | 48 Hour |
| English Hi-Ball (avg. 3 glasses) | 3.5 | 4.4 | 5.0 | 5.0 |
| Luminarc Metro (avg. 3 glasses) | 3.8 | 4.5 | 5.0 | 5.0 |

It is observed that significant glasscare benefit is achieved using smaller ZCLM particle sizes versus ZCLM larger particle sizes.

Test 4

Test 4 is an indirect measure of ZCLM particle crystallinity. The FWHM (full width half maximum) of reflections of an x-ray diffraction (XRD) pattern is a measure of crystalline imperfections and is a combination of instrumental and physical factors. With instruments of similar resolution, one can relate crystal imperfections or crystalline integrity to the FWHM of the peaks that are sensitive to the paracrystalline property. Following that approach, crystalline distortions/perfection are assigned to various ZCLM samples.

Three peaks (200, ~13° 2θ, 6.9 Å; 111, ~22° 2θ, 4.0 Å; 510, 36° 2θ, 2.5 Å) are found to be sensitive to lattice distortion, the 200 reflection is selected for the analysis. The peaks are individually profile-fitted using normal Pearson VII and Pseudo-Voigt algorithms in Jade 6.1 software by MDI. Each peak is profile fitted 10 times with changes in background definition and algorithm to obtain average FWHM with standard deviations. The test results are summarized in Table IX.

TABLE IX

| Sample | Crystallinity 200 Peak Reflection FWHM | Std. Dev. | Relative Zinc Lability (%) |
|---|---|---|---|
| Bruggemann Zinc Carbonate | 0.8625 | 0.0056 | 56.9 |
| Elementis Zinc Carbonate | 0.7054 | 0.0024 | 51.6 |
| Cater Zinc Carbonate#1 | 0.4982 | 0.0023 | 42.3 |

The crystallinity appears to be related to the FWHM of its source. Not wishing to be bound by theory, it is postulated that a lower crystallinity may aid in maximizing zinc lability.

With reference to the polymers described herein, the term weight-average molecular weight is the weight-average molecular weight as determined using gel permeation chromatography according to the protocol found in Colloids and Surfaces A. Physico Chemical & Engineering Aspects, Vol. 162, 2000, pg. 107-121. The units are Daltons.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the subject invention have been described, it will be clear to those skilled in the art that various changes and modifications of the subject invention can be made without departing from the spirit and scope of the invention. It should be understood that the invention is not to be considered limited to the embodiments and examples that are described in the specification.

What is claimed is:

1. A domestic, institutional, industrial, and/or commercial through-the-wash automatic dishwashing detergent composition comprising:

an effective amount of a zinc-containing layered material wherein said zinc-containing layered material comprises one or more compounds selected from the group consisting of: copper zinc carbonate hydroxide, zinc carbonate hydroxide having the formula: $3Zn(OH)_2 \cdot 2ZnCO_3$ or Zn5(OH)6(CO3)2, zinc hydroxide chloride, zinc hydroxide nitrate, zinc hydroxide sulfate, and mixtures thereof;

a) a surfactant; and b) sodium silicate.

2. A composition according to claim 1 wherein said zinc-containing layered material may be present from about 0.001% to about 10% by weight of the composition.

3. A composition according to claim 1 wherein said detergent composition further comprises one or more of the following components: builders, dispersant polymers, carrier mediums, bleaches, bleach activators, bleach catalysts, enzymes, enzyme stabilizing systems, dyes, perfumes, or speckles.

4. A composition according to claim 1 wherein the composition further comprises a dye solution, a bleach catalyst and a mixture thereof.

* * * * *